US007746330B2

(12) United States Patent
Yu et al.

(10) Patent No.: US 7,746,330 B2
(45) Date of Patent: Jun. 29, 2010

(54) CIRCUIT AND METHOD FOR IMPROVING IMAGE QUALITY OF A LIQUID CRYSTAL DISPLAY

(75) Inventors: Chia-Wei Yu, Kaohsiung (TW); Hung-Min Shih, Lugang Township, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 1223 days.

(21) Appl. No.: 11/317,814

(22) Filed: Dec. 22, 2005

(65) Prior Publication Data

US 2007/0146295 A1 Jun. 28, 2007

(51) Int. Cl.
*G09G 3/36* (2006.01)

(52) U.S. Cl. ..... 345/204; 345/87; 345/102; 345/211; 345/213

(58) Field of Classification Search ..... 345/87, 345/102, 204, 211, 213
See application file for complete search history.

(56) References Cited

U.S. PATENT DOCUMENTS

| | | | | |
|---|---|---|---|---|
| 6,114,814 | A * | 9/2000 | Shannon et al. | 315/219 |
| 6,201,589 | B1 | 3/2001 | Tombling et al. | |
| 6,356,331 | B1 | 3/2002 | Ono et al. | |
| 6,466,196 | B1 * | 10/2002 | Isogawa et al. | 345/102 |
| 6,678,027 | B2 | 1/2004 | Park et al. | |
| 6,741,311 | B1 | 5/2004 | Hong et al. | |
| 6,798,483 | B2 | 9/2004 | Lee et al. | |
| 6,819,389 | B2 | 11/2004 | Imayama et al. | |
| 6,890,783 | B2 | 5/2005 | Kimura et al. | |
| 6,924,863 | B2 | 8/2005 | Nishida et al. | |
| 7,009,664 | B2 | 3/2006 | Imayama et al. | |
| 7,161,649 | B2 | 1/2007 | Lee et al. | |
| 7,256,843 | B2 | 8/2007 | Iwakabe et al. | |
| 7,259,820 | B2 | 8/2007 | Matsumoto | |
| 7,362,303 | B2 * | 4/2008 | Jang | 345/102 |
| 2003/0038770 | A1 * | 2/2003 | Lee et al. | 345/102 |
| 2003/0095125 | A1 | 5/2003 | Lim et al. | |
| 2004/0046723 | A1 | 3/2004 | Lin et al. | |
| 2004/0056825 | A1 * | 3/2004 | Min et al. | 345/38 |
| 2004/0056830 | A1 * | 3/2004 | Lee et al. | 345/87 |
| 2004/0095305 | A1 | 5/2004 | Kimura et al. | |
| 2004/0130881 | A1 | 7/2004 | Han et al. | |
| 2004/0257326 | A1 | 12/2004 | Chang | |
| 2005/0052401 | A1 | 3/2005 | Lee | |
| 2005/0110732 | A1 * | 5/2005 | Kim | 345/87 |

* cited by examiner

*Primary Examiner*—Bipin Shalwala
*Assistant Examiner*—Vince E Kovalick
(74) *Attorney, Agent, or Firm*—Morris, Manning & Martin LLP; Tim Tingkang Xia

(57) ABSTRACT

A circuit and method of reducing noises for improving quality of display in a liquid crystal display (LCD) system. The LCD system includes an LCD panel and at least one lamp. In operation the LCD system is supplied with a vertical synchronization signal and a horizontal synchronization signal. In one embodiment, the method comprises the steps of determining a lamp driving frequency for the at least one lamp responsive to the horizontal synchronization signal, and generating a lamp driving signal with the lamp driving frequency to be received by the at least one lamp for producing light, wherein the following formulae (1) and (2) are satisfied:

$$f_{lamp} = \frac{2n-1}{m} H_{sync} + \delta \quad (1)$$

$$\text{and } H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

23 Claims, 3 Drawing Sheets

CIRCUIT AND METHOD FOR IMPROVING IMAGE QUALITY OF A LIQUID CRYSTAL DISPLAY

FIELD OF THE INVENTION

The present invention relates generally to a method and circuit for improving a quality of display on a liquid crystal display (LCD). More particularly, the present invention relates to a method and circuit for generating a lamp driving signal with a lamp driving frequency in response to an input horizontal synchronization signal to drive a backlight module of an LCD device so as to improve quality of display on an LCD screen of the LCD device by reducing or suppressing interference noise appearing on the LCD screen related to the so-called ripple phenomena.

BACKGROUND OF THE INVENTION

An liquid crystal display (LCD) apparatus includes an LCD panel formed with liquid crystal cells and pixel elements with each associating with a corresponding liquid crystal cell and having a liquid crystal capacitor (hereinafter "$C_{LC}$") and a storage capacitor (hereinafter "$C_{ST}$"), a thin film transistor (TFT) electrically coupled with the $C_{LC}$ and $C_{ST}$. These pixel elements are substantially arranged in the form of a matrix having a number of pixel rows and a number of pixel columns. Typically, a plurality of gate signals (scanning signals), generated in response to a horizontal synchronization signal and a vertical synchronization signal, are sequentially applied to the number of pixel rows for sequentially turning on the pixel elements row-by-row. When a gate signal is applied to a pixel row to turn on corresponding TFTs of the pixel elements of a pixel row, a plurality of source signals (data signals) for the pixel row, associated with an image signal to be displayed, are simultaneously applied to the number of pixel columns so as to charge the corresponding $C_{LC}$ and $C_{ST}$ of the pixel row for aligning states of the corresponding liquid crystal cells associated with the pixel row to control light transmittance therethrough. By repeating the procedure for all pixel rows, all pixel elements are supplied with corresponding source signals of the image signal, thereby displaying the image signal thereon. The display of the image signal is in generally controlled by the horizontal synchronization signal and the vertical synchronization signal. Typically, in one period of the vertical synchronization signal, all rows are successively scanned once. The number of times a pixel element of a pixel column is scanned in a second is the frequency of the vertical synchronization signal.

Since liquid crystal molecules in the liquid crystal cells themselves do not emit light, an LCD system usually uses a backlight module or a backlight to illuminate the liquid crystal panel so as to produce an image. A backlight includes lamps, such as cold cathode fluorescent lamps (hereinafter "CCFL"), hot cold cathode fluorescent lamps (hereinafter "HCFL"), external electrode fluorescent lamp (hereinafter "EEFL"), or like, for producing light. These lamps are typically powered by a DC-to-AC inverter. The inverter in turn is powered by another power source such as an LCD power supply. The DC-to-AC inverter converts a DC voltage into a high AC voltage (500-2000 V) for driving the lamps, and regulates light-on and light-off times of the lamps for adjusting the brightness of the liquid crystal panel. To reduce interference noises into circuits of the LCD system from the lamps, all lamps are usually driven in the same period and synchronized with each other.

However, interference noises between signals driving the lamps and the horizontal and vertical synchronization signals may exist and generate a so-called "ripple phenomenon" on a screen of the LCD system, which degrades the displaying quality of the LCD system. For example, if a burst mode inverter is used in a conventional LCD system as the DC-to-AC inverter, when the burst signal frequency of the burst mode inverter is equal or near the frequency of the vertical synchronization signal or its harmonics, a large interference noise will be generated periodically. This periodic noise will appear and disappear on the display screen and generate the ripple phenomenon. For instance, if the frequency of the vertical synchronization signal is 60 Hz, when the burst signal frequency of the burst mode inverter is in harmonics of 60 Hz such as 60 Hz, 120 Hz, 180 Hz, 240 Hz . . . , significant noise will result. The burst signal frequency is often preferably set to be about 150 Hz or higher to avoid being close to the harmonics or flicker perceived by human eyes. However, the tolerance of the burst mode frequency could be big due to tolerances of temperature-dependent components, including especially capacitors, the inverter controller IC. Therefore, the burst mode frequency is not as stable as one would like and the ripple phenomenon is very much a concern.

Therefore, a heretofore unaddressed need exists in the art to address the aforementioned deficiencies and inadequacies.

SUMMARY OF THE INVENTION

The present invention, in one aspect, relates to a method of reducing noises for improving quality of display in an LCD system, wherein the LCD system includes an LCD panel, at least one lamp for producing light to illuminate the LCD panel, and wherein in operation the LCD system is supplied with a video signal, a vertical synchronization signal and a horizontal synchronization signal. In one embodiment, the method comprises the steps of determining a lamp driving frequency for the at least one lamp responsive to the horizontal synchronization signal, and generating a lamp driving signal with the lamp driving frequency to be received by the at least one lamp for producing light responsive to the lamp driving signal, wherein the following formulae (1) and (2) are satisfied:

$$f_{lamp} = \frac{2n-1}{m} H_{sync} + \delta \tag{1}$$

$$H_{sync}/m \geq \delta \geq 0 \tag{2}$$

where $H_{sync}$ is the frequency of the horizontal synchronization signal in unit of (Hz), $f_{lamp}$ is the lamp driving frequency for the lamp driving signal in unit of (Hz); m, n=1, 2, 3, . . . , an integer; and δ indicates the permissible error of the lamp driving frequency.

The lamp driving frequency, $f_{lamp}$, is determinable in a range of $f_{lamp}$(min) to $f_{lamp}$(max), $f_{lamp}$(min) being a minimum driving frequency for the at least one lamp, and $f_{lamp}$(max) being a maximum driving frequency for the at least one lamp, respectively. The determining step comprises the step of calculating the lamp driving frequency, $f_{lamp}$, from the formulae (1) and (2).

In one embodiment, the determining step comprises the steps of obtaining a first number, n1, from the formula n1=(m $f_{lamp}$(min)/$H_{sync}$+1)/2, obtaining a second number, n2, from the formula n2=(m $f_{lamp}$(max)/$H_{sync}$+1)/2, obtaining an integer N that is the smallest integer between the first number n1 and the second number n2, and determining the lamp driving frequency, $f_{lamp}$, for $\delta=0$ from the formula $f_{lamp}=((2N-1)H_{sync})/m$.

The LCD system may have a clock with a crystal oscillation frequency, $f_{crystal}$, and in this embodiment, the determining step further comprises the steps of obtaining an intermediate counting number, $f_{cnt}$, from the formula $f_{cnt}$=Integer $[(f_{crystal}/f_{lamp})/2]$, and determining a real time lamp driving frequency, $f_{lamp}$, from the formula $f_{lamp}=(f_{crystal}/f_{cnt})/2$.

The method further comprises the step of constructing a predetermined table, wherein the predetermined table as constructed contains a first column of data, each element of the first column of data representing a possible frequency of the horizontal synchronization signal in unit of (Hz), and a second column of data, each element of the second column of data representing a corresponding lamp driving frequency, $f_{lamp}$, for $\delta=0$ from the formula $f_{lamp}=((2N-1)H_{sync})/m$. In this embodiment, the determining step comprises the step of finding the lamp driving frequency, $f_{lamp}$, from the predetermined table for a given horizontal synchronization signal.

The present invention, in another aspect, relates to an LCD system that has an LCD panel, at least one lamp for producing light to illuminate the LCD panel, and an inverter. In operation, the LCD system, is supplied with a video signal, a vertical synchronization signal and a horizontal synchronization signal. In response to the horizontal synchronization signal, the inverter generates a lamp driving signal with a lamp driving frequency, $f_{lamp}$, to be received by the at least one lamp for producing light responsive to the lamp driving signal. The lamp driving frequency $f_{lamp}$ and the frequency $H_{sync}$ of the horizontal synchronization signal satisfy the formulae (1) and (2). The LCD system further includes a control circuit for controlling the inverter, wherein the control circuit is capable of calculating the lamp driving frequency, $f_{lamp}$, from the formulae (1) and (2). In one embodiment, the control circuit comprises a complex programmable logic device (hereinafter "CPLD").

The LCD system may further comprise a clock with a crystal oscillation frequency, $f_{crystal}$, from which an intermediate counting number, $f_{cnt}$, is obtainable from the formula $f_{cnt}$=Integer$[(f_{crystal}/f_{lamp})/2]$, and a real time lamp driving frequency, $f_{lamp}$, is obtainable from the formula $f_{lamp}=(f_{crystal}/f_{cnt})/2$.

The LCD system additionally may have a memory for containing a predetermined table, where the predetermined table contains a first row of data, each element of the first row of data representing a possible frequency of the horizontal synchronization signal in unit of (Hz), and a second row of data, each element of the second row of data representing a corresponding lamp driving frequency, $f_{lamp}$, which is determined by practicing the method(s) provided by the present invention.

As an example but not as a limitation, the inverter comprises a DC-to-AC inverter. The LCD panel comprises a plurality of pixel elements arranged in a matrix for receiving the video signal.

In yet another aspect, the present invention relates to a circuit to be used in an LCD system, wherein the LCD system includes an LCD panel, and at least one lamp for producing light to illuminate the LCD panel. In one embodiment, the circuit has an inverter and a control circuit for controlling the inverter. In operation the control circuit receives a horizontal synchronization signal and outputs a control signal to the inverter so as to generate a lamp driving signal with a lamp driving frequency to be received by the at least one lamp for producing light responsive to the lamp driving signal. The relationship between the lamp driving frequency $f_{lamp}$ and the frequency $H_{sync}$ of the horizontal synchronization signal is governed by the formulae (1) and (2).

The control circuit can be an integral part of the inverter. Alternatively, the inverter and the control circuit can be separate components of the LCD system but in communication to each other. As an example but not as a limitation, the inverter can be a DC-to-AC inverter. The control circuit can be a complex programmable logic device.

In a further aspect, the present invention relates to a circuit to be used in an LCD system, where the LCD system includes an LCD panel and at least one lamp for producing light to illuminate the LCD panel. In one embodiment, the circuit has an inverter, wherein in operation and in response to a horizontal synchronization signal, the inverter generates a lamp driving signal with a lamp driving frequency to be received by the at least one lamp for producing light responsive to the lamp driving signal. The lamp driving frequency $f_{lamp}$ and the frequency $H_{sync}$ of the horizontal synchronization signal satisfy the formulae (1) and (2).

In yet a further aspect, the present invention relates to a method of reducing noises for improving quality of display in an LCD system. The LCD system includes an LCD panel and at least one lamp for producing light to illuminate the LCD panel. In operation the LCD system is supplied with a video signal, a vertical synchronization signal and a horizontal synchronization signal. In one embodiment, the method includes the step of generating a lamp driving signal with the lamp driving frequency to be received by the at least one lamp for producing light responsive to the lamp driving signal, where the lamp driving frequency is not a harmonic of the frequency of the horizontal synchronization signal. In one embodiment, the lamp driving frequency $f_{lamp}$ and the frequency $H_{sync}$ of the horizontal synchronization signal satisfy the formulae (1) and (2).

These and other aspects of the present invention will become apparent from the following description of the preferred embodiment taken in conjunction with the following drawings, although variations and modifications therein may be affected without departing from the spirit and scope of the novel concepts of the disclosure.

DETAILED DESCRIPTION OF THE INVENTION

Figure 1:
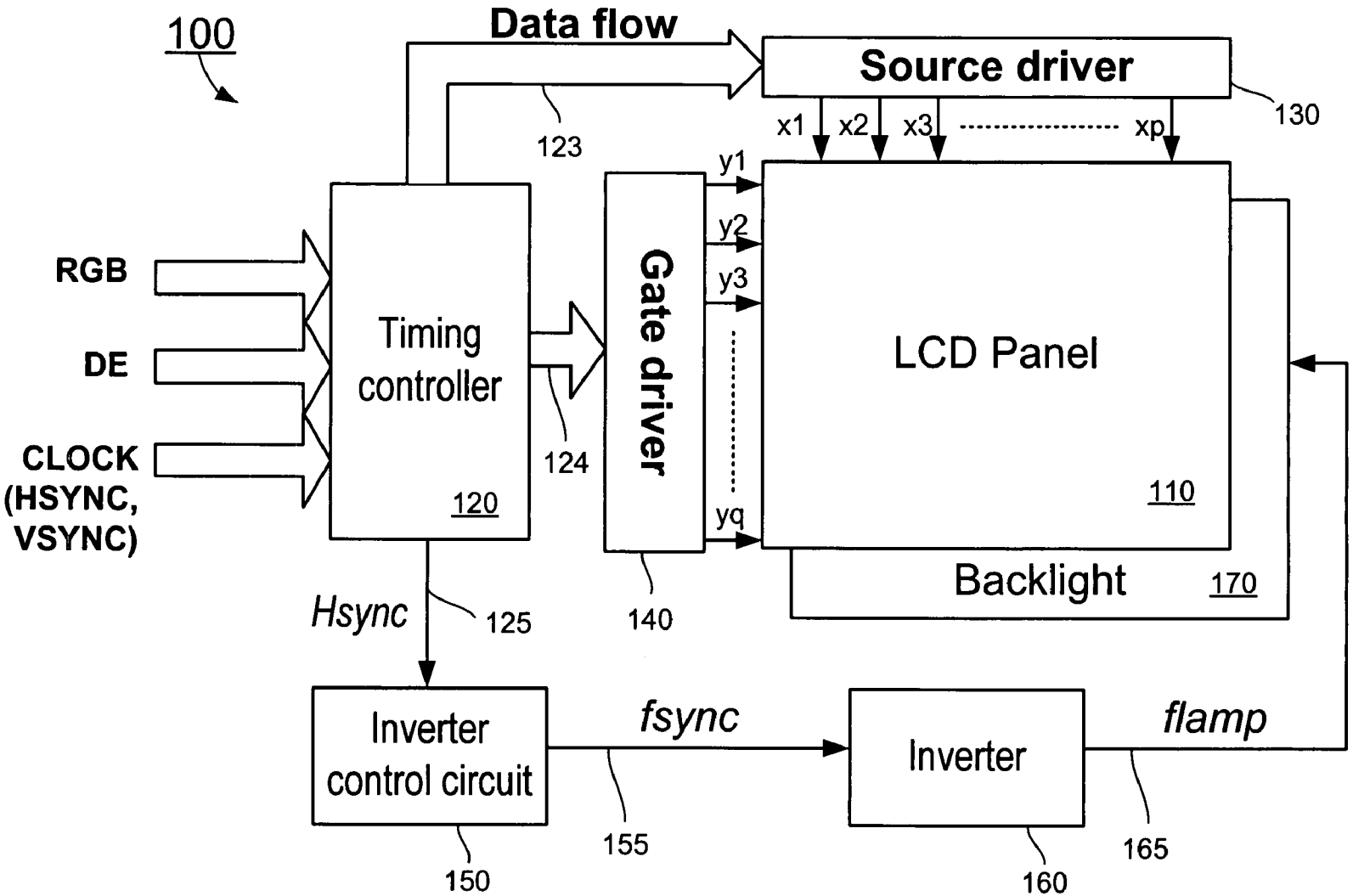
FIG. 1 shows a block diagram of a liquid crystal display device according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1-3. In accordance with the purposes of this invention, as embodied and broadly described herein, this invention, in one aspect, relates to a method and circuit for generating a lamp driving signal with a lamp driving frequency in response to an input horizontal synchronization signal to drive a backlight of an LCD device so as to improve quality of display on an LCD screen of the LCD device by reducing or suppressing interference noise appearing on the LCD screen related to the so-called ripple phenomena.

Referring now to FIG. 1, an LCD device 100 is shown according to one embodiment of the present invention. In the embodiment, the LCD 100 includes an LCD panel 110, a source driver 130 connected to the LCD panel 110, a gate diver 140 connected to the LCD panel 110, a timing controller 120 connected to the source driver 130 and the gate diver 140, a backlight 170 coupled with the LCD panel 110 for illuminating the LCD panel 110, an inverter 160 connected to the backlight 170 for driving the backlight 170, an inverter control circuit 150 in communication with the timing controller 120 and an inverter 160 for generating an inverter driving signal responsive to an input signal from timing controller 120.

The LCD panel 110 is formed with liquid crystal cells and pixel elements with each associating with a corresponding liquid crystal cell and having a switching element such as a TFT electrically coupled with data lines and gate lines, and a $C_{LC}$ and a $C_{ST}$ electrically coupled with the TFT (not shown). The gate lines extend substantially in a row direction and are substantially parallel to each other and are adapted for transmitting gate signals (scanning signals), while the data lines extend substantially in a column direction and are substantially parallel to each other and are adapted for transmitting data signals.

The timing controller 120 has a plurality of input ports for receiving input signals including an image (video) signal, RGB, a data enable signal, DE, a clock signal, CLOCK, which comprises a horizontal synchronization signal, HSYNC, and a vertical synchronization signal, VSYNC, respectively, and a plurality of output ports for providing control signals including an image data flow 123, a scanning signal 124, the input horizontal synchronization signal HSYNC to the source driver 130, the gate driver 140 and the inverter control circuit 150, respectively.

The gate driver 140 is electrically connected to the gate lines of the LCD panel 110, and adapted for generating a plurality of gate signals, y1, y2, y3, . . . yq, for activating the gate lines of the LCD panel 100 in response to the control signal generated from the time controller 120, and providing the gate lines of the LCD panel 100 with the plurality of gate signals y1, y2, y3, . . . yq sequentially.

The source driver 130 is electrically connected to the data lines of the LCD panel 110, and adapted for receiving a packet of the image data RGB from the timing controller 120, converting the image data RGB into a plurality of image signals, x1, x2, x3, . . . xp, in terms of analog data voltages selected from gray voltages in response to the control signals from the timing controller 120, and applying the plurality of image signals x1, x2, x3, . . . xp to the data lines of the LCD panel 110, respectively.

The inverter control circuit 150 includes a complex programmable logic device (CPLD) and is adapted such that when a horizontal synchronization signal HSYNC 125 with a frequency $H_{sync}$ is received from the time controller 120, an inverter driving signal 155 with a frequency, $f_{sync}$, is generated and provided to the inverter 160 so that the inverter 160 generates a lamp driving signal 165 with a lamp driving frequency, $f_{lamp}=f_{sync}/2$, to drive the backlight 170 to illuminate the LCD panel 110. The frequency $H_{sync}$ of the horizontal synchronization signal HSYNC and the lamp driving frequency $f_{sync}$ of the lamp driving signal satisfy the following formulae:

$$f_{lamp} = \frac{2n-1}{m} H_{sync} + \delta, \tag{1}$$

$$H_{sync}/m \geq \delta \geq 0, \tag{2}$$

where both $H_{sync}$ and $f_{lamp}$ are in unit of (Hz); m, n=1, 2, 3, . . . , an integer; and δ indicates the permissible error of the lamp driving frequency. In one embodiment, the inverter control circuit 150 for controlling the inverter 160 is capable of calculating the lamp driving frequency, $f_{lamp}$, from the formulae (1) and (2). The inverter 160 includes a DC-to-AC inverter. Other types of inverters can also be employed to practice the present invention.

In operation, the timing controller 120 is supplied with input signals including an image (video) signal, RGB, a data enable signal, DE, a clock signal, CLOCK, which comprises a horizontal synchronization signal, HSYNC, and a vertical synchronization signal, VSYNC. The timing controller 120 then processes the image signal RGB to generate an image data flow 123 and provides the data flow 123 to the source driver 130. The source driver 130 receives and converts the data flow 123 into a plurality of image data x1, x2, . . . xp, in terms of gray scale voltage signals, and provides the gray scale voltage signals to the source electrodes of the corresponding TFTs via the data lines. Meanwhile, the timing controller 120 generates a scan signal 124 responsive to the horizontal synchronization signal HSYNC, and a vertical synchronization signal VSYNC, and provides the scan signal 124 to the gate driver 140. The gate driver 140 in turn generates a plurality of gate signals y1, y2, y3, . . . yq, for activating the gate lines of the LCD panel 100 in response to the scan signal 124 generated from the time controller 120, and provides the plurality of gate signals y1, y2, y3, . . . yq to the gate electrodes of the corresponding TFT via the gate lines thereby sequentially turning on the pixel elements row-by-row. When a gate signal is applied to a gate line to turn on corresponding TFTs of the pixel elements associated with the gate line, the plurality of image data x1 x2, . . . xp are simultaneously applied to the data lines so as to charge the corresponding $C_{LC}$ and $C_{ST}$ of the pixel row of the gate line thereby aligning states of the corresponding liquid crystal cells associated with the pixel row to control light transmittance therethrough. By repeating the procedure for all gate lines (pixel rows), all pixel elements are supplied with corresponding data signals of the image signal, thereby displaying the image signal thereon.

In the meantime, the inverter 160 generates the lamp driving signal 165 having the frequency $f_{lamp}$ satisfying the formulae (1) and (2) to drive the backlight 170. The light emitting from the backlight 170 passes through the liquid crystal cells and varies its polarization according to the orientations of the liquid crystal cells, thereby illuminating the LCD panel 110.

Figure 2:
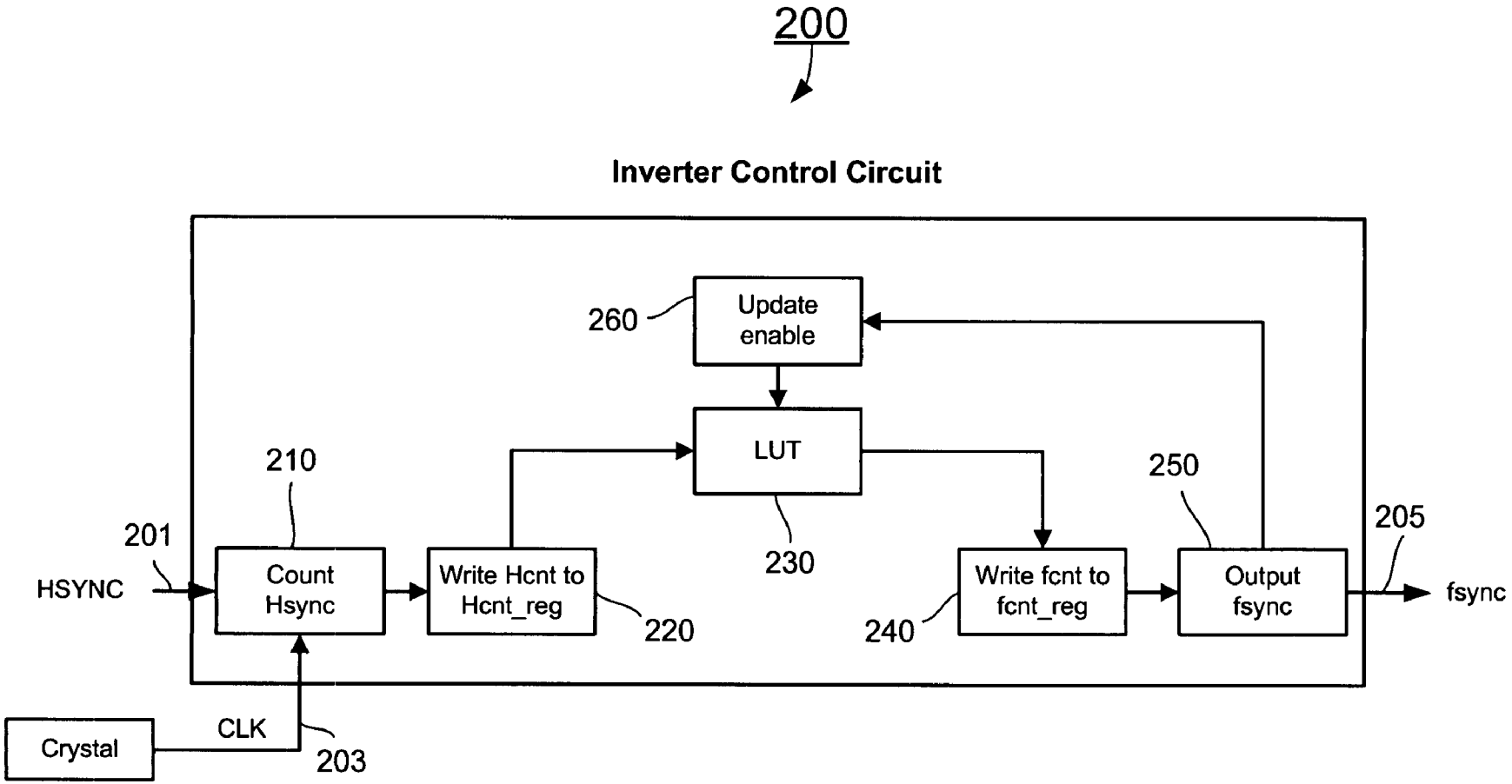
FIG. 2 shows a block diagram of an inverter control circuit according to one embodiment of the present invention.

FIG. 2 shows a block diagram of an inverter control circuit 200 according to one embodiment of the present invention. As shown in FIG. 2, input signals including a signal 201 with the frequency $H_{sync}$ of the horizontal synchronization signal, and a clock signal CLK 203 with a crystal oscillation frequency, $f_{crystal}$, are introduced into the inverter control circuit 200, the inverter control circuit 200 then processes the input signals and generates an inverter driving signal 205 with a frequency $f_{sync}$ corresponding to the frequency $H_{sync}$ of the horizontal synchronization signal. The clock signal CLK 203 in this exemplary embodiment acts as a counter therein to calculate a counting number, $H_{cnt}$, of the signal 201 with respect to the crystal oscillation frequency $f_{crystal}$.

As shown in FIG. 2, in one embodiment, the process of generating the inverter driving signal 205 with the frequency $f_{sync}$ in response to the horizontal synchronization signal HSYNC 201 includes the following steps: at step 210, counting number $H_{cnt}$ of the signal HSYNC 201 with respect to the crystal oscillation frequency $f_{crystal}$ is calculated from the formula $$H_{cnt} = int\left[\frac{f_{crystal}}{H_{sync}}\right], \tag{3}$$

where int[ ] is an integer function operation known to people skilled in the art. For example, int[5.4]=5. The counting number $H_{cnt}$ is then written into a memory address of Hcnt_reg at step 220.

At step 230, the counting number $H_{cnt}$ is compared with a lookup table (hereinafter "LUT"). The LUT is pre-calculated, based on the frequency $H_{sync}$ of the horizontal synchronization signal HSYNC 201, the frequency $f_{crystal}$ of the clock signal CLK 203, a minimum frequency $f_{lamp}$(min) and a maximum frequency $f_{lamp}$(max) of the lamp driving signal generated from the inverter. The minimum frequency $f_{lamp}$(min) and the maximum frequency $f_{lamp}$(max) of the lamp driving signal are pre-determined parameters for the backlight. Specifically, a first number n1 and a second number n2 are calculated from the following formulae (4) and (5):

$$n1 = \left(\frac{mf_{lamp}(\min)}{H_{sync}} + 1\right)\Big/2, \tag{4}$$

$$n2 = \left(\frac{mf_{lamp}(\max)}{H_{sync}} + 1\right)\Big/2, \tag{5}$$

where m=1, 2, 3, . . . , an integer. Then the smallest integer between the first number n1 and the second number n2 is chosen as number N. The lamp driving frequency $f_{lamp}$ of the lamp driving signal in the ideal situation, where δ=0, is obtained from the formula (1) with n replaced by N, $$f_{lamp}(\delta = 0) = \frac{2N-1}{m} H_{sync}. \tag{6}$$

The frequency $f_{sync}$ of the inverter driving signal 205 generated from the inverter control circuit 200 for δ=0 is then determined by $$f_{sync}(\delta=0)=2\times f_{lamp}(\delta=0) \tag{7}$$

An intermediate counting number, $f_{cnt}$, of the inverter driving signal 205 with respect to the crystal oscillation frequency $f_{crystal}$ is obtainable from the formula $$f_{cnt} = int\left[\frac{f_{crystal}}{f_{sync}(\delta = 0)}\right]. \tag{8}$$

The actual frequency $f_{sync}$ of the inverter driving signal 205 of the inverter control circuit 200 is determined by the formula (9):

$$f_{sync} = f_{sync}(\delta) = \frac{f_{crystal}}{f_{cnt}}. \tag{9}$$

Then the real time lamp driving frequency $f_{lamp}$ is obtainable from the formula (10):

$$f_{lamp} = f_{lamp}(\delta) = \frac{f_{sync}(\delta)}{2}. \tag{10}$$

From the formulae (1), (6), (7) and (10), the permissible error of the lamp driving frequency, δ, can be estimated to be, $$\delta = \frac{f_{sync}(\delta) - f_{sync}(0)}{2}. \tag{11}$$

Therefore, for given crystal oscillation frequency $f_{crystal}$, minimum lamp driving frequency $f_{lamp}$(min), maximum lamp driving frequency $f_{lamp}$(max), and a horizontal synchronization frequency $H_{sync}$, the inverter control circuit 200 outputs a corresponding frequency $f_{sync}$ to an inverter, so that the inverter generates a lamp driving signal with a corresponding lamp driving frequency $f_{lamp}$, which can reduce noises such as ripple phenomena in the LCD system because this lamp driving frequency is not a harmonic of the horizontal synchronization frequency $H_{sync}$. Corresponding parameter data calculated can be formed as a table, which can be employed as an LUT.

In one embodiment, an LUT contains a first column of data, each element of the first column of data representing a possible frequency of the horizontal synchronization signal in unit of (Hz), and a second column of data, each element of the second column of data representing a corresponding lamp driving frequency, $f_{lamp}$, for δ=0 from the formula (6). The LUT is written in the memory of the inverter control circuit 200. For a given horizontal synchronization signal, the corresponding lamp driving frequency $f_{lamp}$ can be found by looking up the LUT. The LUT may contain additional columns of data.

As an example but not as a limitation, m is set to equal 8 in the formulae (1), (2), and (4)-(6) in obtaining LUTs as shown in Tables 1 and 2. Accordingly, the frequency $H_{sync}$ of the horizontal synchronization signal HSYNC and the lamp driving frequency $f_{sync}$ of the lamp driving signal satisfy the following formulae:

$$f_{lamp} = \frac{2n-1}{8} H_{sync} + \delta, \tag{12}$$

$$H_{sync}/8 \geq \delta \geq 0. \tag{13}$$

Table 1 shows an LUT according to one embodiment of the present invention, which is obtained based on the following given parameters: $f_{crystal}$=49090900 Hz, $f_{lamp}$(min)=56500 Hz, and $f_{lamp}$(max)=68000 Hz. The LUT contains 10 data columns including $H_{sync}$, $H_{cnt}$, n1, n2, N, $f_{lamp}$(δ=0), $f_{sync}$(δ=0), $f_{cnt}$, $f_{sync}$(δ) and δ. The LUT shows that, for a given $H_{sync}$ there is a corresponding $f_{sync}(\delta)$, and hence a corresponding $f_{lamp}(\delta)=\frac{1}{2} f_{sync}(\delta)$. For example, for a given horizontal synchronization signal with a frequency $H_{sync}$=42000 Hz, a corresponding frequency $f_{sync}(\delta)$=115508 Hz is found by looking up Table 1, and a corresponding lamp driving signal with a frequency $f_{lamp}(\delta)=\frac{1}{2} f_{sync}(\delta)$=57754 Hz will be generated. Table 1 may be written into the memory of the inverter control circuit 200 for looking up in operation.

TABLE 1

A First Exemplary LUT

| $H_{sync}$ (Hz) | $H_{cnt}$ (times) | n1 | n2 | N | $f_{lamp}(\delta = 0)$ (Hz) | $f_{sync}(\delta = 0)$ (Hz) | $f_{cnt}$ (times) | $f_{sync}(\delta)$ (Hz) | δ (Hz) |
|---|---|---|---|---|---|---|---|---|---|
| 39000 | 1259 | 6.29 | 7.47 | 7 | 63375 | 126750 | 387 | 126849.9 | 49.9345 |
| 40000 | 1227 | 6.15 | 7.30 | 7 | 65000 | 130000 | 378 | 129870.1 | −64.9471 |
| 41000 | 1197 | 6.1 | 7.13 | 7 | 66625 | 133250 | 368 | 133399.2 | 74.59239 |
| 42000 | 1169 | 5.88 | 6.98 | 6 | 57750 | 115500 | 425 | 115508 | 4 |
| 43000 | 1142 | 5.76 | 6.83 | 6 | 59125 | 118250 | 415 | 118291.3 | 20.66265 |
| 44000 | 1116 | 5.64 | 6.68 | 6 | 60500 | 121000 | 406 | 120913.5 | −43.2266 |
| 45000 | 1091 | 5.52 | 6.54 | 6 | 61875 | 123750 | 397 | 123654.7 | −47.67 |
| 46000 | 1067 | 5.41 | 6.41 | 6 | 63250 | 126500 | 388 | 126522.9 | 11.46907 |
| 47000 | 1044 | 5.31 | 6.29 | 6 | 64625 | 129250 | 380 | 129186.6 | −31.7105 |
| 48000 | 1023 | 5.21 | 6.17 | 6 | 66000 | 132000 | 372 | 131964.8 | −17.6075 |
| 49000 | 1002 | 5.11 | 6.05 | 6 | 67375 | 134750 | 364 | 134865.1 | 57.55495 |
| 50000 | 982 | 5.02 | 5.94 | 6 | 68750 | 137500 | 357 | 137509.5 | 4.761905 |
| 51000 | 963 | 4.93 | 5.83 | 5 | 57375 | 114750 | 428 | 114698.4 | −25.8178 |

An LUT can have more or less columns of data in comparison with Table 1. Table 2 shows an alternative LUT that contains only two columns: the counting number $H_{cnt}$ and the corresponding counting number $f_{cnt}$, which is obtained based on the same given parameters: $f_{crystal}$=49090900 Hz, $f_{lamp}$(min)=56500 Hz, and $f_{lamp}$(max)=68000 Hz.

TABLE 2

An Alternative Exemplary LUT

| $H_{cnt}$ (times) | $f_{cnt}$ (times) |
|---|---|
| 1259 | 387 |
| 1227 | 378 |
| 1197 | 368 |
| 1169 | 425 |
| 1142 | 415 |
| 1116 | 406 |
| 1091 | 397 |
| 1067 | 388 |
| 1044 | 380 |
| 1023 | 372 |
| 1002 | 364 |
| 982 | 357 |
| 963 | 428 |

For example, for a given horizontal synchronization signal with a frequency, $H_{sync}$=39000 Hz, the counting number $H_{cnt}$=1259 is obtained at step 210 and is then written into the Hcnt_reg address of the memory of the inverter control circuit 200. By looking up the LUT (Table 2), the corresponding counting number $f_{cnt}$=387 is found in the first row of Table 2. The counting number $f_{cnt}$ is then written into the fcnt_reg address of the memory of the inverter control circuit 200 at step 240. Based on the counting number $f_{cnt}$, the frequency $f_{sync}$ of the inverter driving signal 205 is determined at step 250. Then an update enable to the LUT is performed at step 260.

Figure 3:
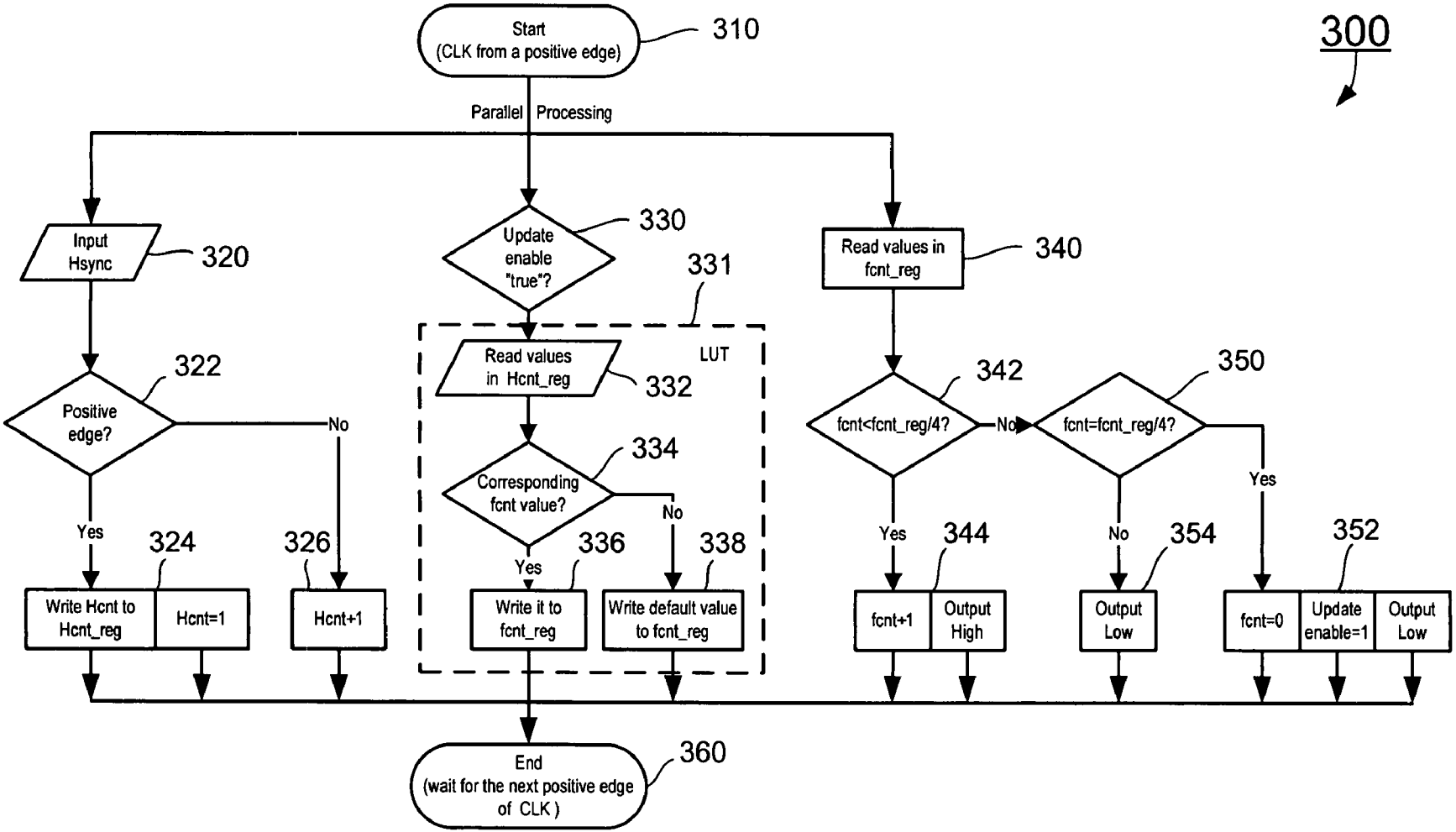
FIG. 3 shows a flow chart of the inverter control circuit of FIG. 2 in operation.

FIG. 3 shows an exemplary flow chart 300 for operating the inverter control circuit shown in FIG. 2 to generate an inverter driving signal with a frequency $f_{sync}$ corresponding to a horizontal synchronization signal with a frequency $H_{sync}$. In this embodiment, the clock signal CLK and the input horizontal synchronization signal HSYNC and the inverter driving signal are characterized with a rectangle wave with each period having a positive edge, and the inverter driving signal is characterized with a rectangle wave with each period having a high (voltage) and a low (voltage). With reference to FIG. 3, an operation starts from a positive edge of the clock signal CLK at step 310, from which three processes proceed in parallel. At step 322, the input horizontal synchronization signal Hsync 320 is determined whether it is at a positive edge. If the input signal HSYNC 320 is at the positive edge, the inverter control circuit writes Hcnt that is counted at last time into a Hcnt_reg address of its memory and sets Hcnt=1 at step 324. Otherwise, it sets Hcnt=Hcnt+1 at step 326. At step 330, it is determined if update enable is "true." If update enable=1 ("true"), the inverter control circuit looks up an LUT stored in its memory at step 331, which includes reading values in the Hcnt_reg address at step 332, then determining if there is a corresponding value of fcnt in the LUT at step 334. If the corresponding value of fcnt is found, the inverter control circuit writes it to the fcnt_reg address at step 336. Otherwise, it writes a default value of fcnt to the fcnt_reg address at step 338. The third process includes the step of reading values in the fcnt_reg address at step 340. Positive duty of fsync (or flamp) is set 25% in the exemplary flow chart 300. And positive duty of fsync is set any duty if inverter can correctly receive it and produce flamp. Then it determines if fcnt<fcnt_reg/4 at step 342. If fcnt<fcnt_reg/4, the inverter control circuit sets fcnt=fcnt+1 and outputs the inverter driving signal with the high voltage at step 344. Otherwise, at step 350 and step 354, it outputs the inverter driving signal with the low voltage. At step 352, the inverter control circuit may set fcnt=0, set update enable=1, and output the inverter driving signal with the low voltage. Then the inverter control circuit is ready for taking next positive edge of the clock signal CLK. The above three processes are thus repeated from the next positive edge of the clock signal CLK. As time goes, the inverter control circuit outputs an inverter driving signal with voltage highs and lows, thereby having a frequency $f_{sync}$ that is corresponding to the frequency $H_{sync}$ of the input horizontal synchronization signal HSYNC 320.

Another aspect of the present invention provides a method of reducing noises such as ripple phenomena for improving quality of display in an LCD system. The LCD system has an LCD panel and at least one lamp for producing light to illuminate the LCD panel, and in operation, is supplied with a video signal, a vertical synchronization signal and a horizontal synchronization signal having a frequency $H_{sync}$. In one embodiment, the method includes the step of determining a lamp driving frequency $f_{lamp}$ for the at least one lamp responsive to the horizontal synchronization signal. The lamp driving frequency $f_{lamp}$ is governed by the formulae (1) and (2). The method further includes the step of generating a lamp driving signal with the lamp driving frequency $f_{lamp}$ to be received by the at least one lamp for producing light responsive to the lamp driving signal. The determining and generating steps can be performed with an inverter control circuit and/or an inverter, respectively, as disclosed above.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method of reducing noises for improving quality of display in a liquid crystal display (LCD) system, wherein the LCD system includes an LCD panel, at least one lamp for producing light to illuminate the LCD panel, and wherein in operation the LCD system is supplied with a video signal, a vertical synchronization signal and a horizontal synchronization signal, comprising the steps of:

a. determining a lamp driving frequency for the at least one lamp responsive to the horizontal synchronization signal; and b. generating a lamp driving signal with the lamp driving frequency to be received by the at least one lamp for producing light responsive to the lamp driving signal, wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

2. The method of claim 1, wherein the determining step comprises the step of calculating the lamp driving frequency, $f_{lamp}$, from the formulae (1) and (2).

3. The method of claim 1, wherein the lamp driving frequency, $f_{lamp}$, is determinable in a range of $f_{lamp}$(min) to $f_{lamp}$(max), $f_{lamp}$(min) being a minimum driving frequency for the at least one lamp, and $f_{lamp}$(max) being a maximum driving frequency for the at least one lamp, respectively.

4. The method of claim 3, wherein the determining step comprises the steps of:

a. obtaining a first number, n1, from the formula n1=(m $f_{lamp}$(min)/$H_{sync}$+1)2;

b. obtaining a second number, n2, from the formula n2=(m $f_{lamp}$(max)/$H_{sync}$+1)/2;

c. obtaining an integer N that is the smallest integer between the first number n1 and the second number n2; and d. determining the lamp driving frequency, $f_{lamp}$, for δ=0 from the formula $f_{lamp}$=((2N−1)$H_{sync}$)/m.

5. The method of claim 4, wherein the LCD system has a clock with a crystal oscillation frequency, $f_{crystan}$, and the determining step further comprises the steps of:

a. obtaining an intermediate counting number, $f_{cnt}$, from the formula $f_{cnt}$=Integer[($f_{crystal}$/$f_{lamp}$)/2]; and b. determining a real time lamp driving frequency, $f_{lamp}$, from the formula $f_{lamp}$=($f_{crystal}$/$f_{cnt}$)/2.

6. The method of claim 4, further comprises the step of constructing a predetermined table, wherein the predetermined table contains a first row of data, each element of the first row of data representing a possible frequency of the horizontal synchronization signal in unit of (Hz), and a second row of data, each element of the second row of data representing a corresponding lamp driving frequency, $f_{lamp}$, for δ=0 from the formula $f_{lamp}$=((2N−1)$H_{sync}$)/m.

7. The method of claim 1, wherein the determining step comprises the step of finding the lamp driving frequency, $f_{lamp}$, from the predetermined table for a given horizontal synchronization signal.

8. A liquid crystal display (LCD) system, comprising:

a. an LCD panel;

b. at least one lamp for producing light to illuminate the LCD panel; and c. an inverter, wherein in operation the LCD system is supplied with a video signal, a vertical synchronization signal and a horizontal synchronization signal;

wherein in response to the horizontal synchronization signal, the inverter generates a lamp driving signal with a lamp driving frequency to be received by the at least one lamp for producing light responsive to the lamp driving signal; and wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

9. The LCD system of claim 8, further comprising a control circuit for controlling the inverter, wherein the control circuit is capable of calculating the lamp driving frequency, $f_{lamp}$, from the formulae (1) and (2).

10. The LCD system of claim 9, wherein the control circuit comprises a complex programmable logic device.

11. The LCD system of claim 8, wherein the lamp driving frequency, $f_{lamp}$, is determinable in a range of $f_{lamp}$(min) to $f_{lamp}$(max), $f_{lamp}$(min) being a minimum driving frequency for the at least one lamp, andf $f_{lamp}$(max) being a maximum driving frequency for the at least one lamp, respectively.

12. The LCD system of claim 8, further comprising a clock with a crystal oscillation frequency, $f_{crystal}$, from which an intermediate counting number, $f_{cnt}$, is obtainable from the formula $f_{cnt}$=Integer[($f_{crystal}/f_{lamp}$)/2], and a real time lamp driving frequency, $f_{lamp}$, is obtainable from the formula $f_{lamp}$=($f_{crystal}/f_{cnt}$)/2.

13. The LCD system of claim 8, further comprising a memory for containing a predetermined table, wherein the predetermined table contains a first column of data, each element of the first column of data representing a possible frequency of the horizontal synchronization signal in unit of (Hz), and a second column of data, each element of the second column of data representing a corresponding lamp driving frequency, $f_{lamp}$, for δ=0 from the formula $f_{lamp}$=((2N−1) $H_{sync}$)/m.

14. The LCD system of claim 8, wherein the inverter comprises a DC-to-AC inverter.

15. The LCD system of claim 8, wherein the LCD panel comprises a plurality of pixel elements arranged in a matrix for receiving the video signal.

16. A circuit to be used in a liquid crystal display (LCD) system, wherein the LCD system includes an LCD panel, and at least one lamp for producing light to illuminate the LCD panel, comprising:

a. an inverter; and b. a control circuit for controlling the inverter, wherein in operation the control circuit receives a horizontal synchronization signal and outputs a control signal to the inverter so as to generate a lamp driving signal with a lamp driving frequency to be received by the at least one lamp for producing light responsive to the lamp driving signal; and wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

17. The circuit of claim 16, wherein the inverter comprises a DC-to-AC inverter.

18. The circuit of claim 16, wherein the control circuit comprises a complex programmable logic device.

19. A circuit to be used in a liquid crystal display (LCD) system, wherein the LCD system includes an LCD panel, and at least one lamp for producing light to illuminate the LCD panel, comprising:

a. an inverter, wherein in operation and in response to a horizontal synchronization signal, the inverter generates a lamp driving signal with a lamp driving frequency to be received by the at least one lamp for producing light responsive to the lamp driving signal; and wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

20. The circuit of claim 19, wherein the inverter comprises a DC-to-AC inverter.

21. A circuit to be used in a liquid crystal display (LCD) system, wherein the LCD system includes an LCD panel, and at least one lamp for producing light to illuminate the LCD panel, comprising an inverter, wherein in operation and in response to a horizontal synchronization signal, the inverter generates a lamp driving signal with a lamp driving frequency to be received by the at least one lamp for producing light responsive to the lamp driving signal; and wherein the lamp driving frequency is not a harmonic of the frequency of the horizontal synchronization signal; and wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

22. The circuit of claim 21, wherein the inverter comprises a DC-to-AC inverter.

23. A method of reducing noises for improving quality of display in a liquid crystal display (LCD) system, wherein the LCD system includes an LCD panel, at least one lamp for producing light to illuminate the LCD panel, and wherein in operation the LCD system is supplied with a video signal, a vertical synchronization signal and a horizontal synchronization signal, comprising the step of generating a lamp driving signal with a lamp driving frequency to be received by the at least one lamp for producing light responsive to the lamp driving signal, wherein the lamp driving frequency is not a harmonic of the frequency of the horizontal synchronization signal; and wherein the following formulae (1) and (2) are satisfied:

$$f_{lamp} = \frac{2n-1}{m} H_{sync} + \delta \quad (1)$$

$$H_{sync}/m \geq \delta \geq 0 \quad (2)$$

where $H_{sync}$ is the frequency of the horizontal synchronization signal in unit of (Hz); $f_{lamp}$ is the lamp driving frequency for the lamp driving signal in unit of (Hz); m, n=1, 2, 3, . . . , an integer; and δ indicates the permissible error of the lamp driving frequency.

* * * * *